US007670563B2

(12) United States Patent
Zimmermann et al.

(10) Patent No.: US 7,670,563 B2
(45) Date of Patent: Mar. 2, 2010

(54) CENTRIFUGE AND A SUPPORT FOR USE IN A CENTRIFUGE

(75) Inventors: Jürgen Zimmermann, Mannheim (DE); Christian Boulin, Wiesloch (DE); Vladimir Benes, Gaiberg (DE); Leo Burger, Heidelberg (DE)

(73) Assignee: European Molecular Biology Laboratory, Heidelberg (DE)

( * ) Notice: Subject to any disclaimer, the term of this patent is extended or adjusted under 35 U.S.C. 154(b) by 399 days.

(21) Appl. No.: 11/355,273

(22) Filed: Feb. 15, 2006

(65) Prior Publication Data

US 2006/0188411 A1 Aug. 24, 2006

Related U.S. Application Data

(63) Continuation of application No. PCT/DE2004/001774, filed on Aug. 6, 2004.

(30) Foreign Application Priority Data

Aug. 15, 2003 (DE) ..... 103 38 136

(51) Int. Cl.
*B01L 9/00* (2006.01)

(52) U.S. Cl. ..... 422/104; 422/72; 422/102; 494/21

(58) Field of Classification Search ..... 422/72, 422/102, 104; 494/19–21
See application file for complete search history.

(56) References Cited

U.S. PATENT DOCUMENTS

| | | | | |
|---|---|---|---|---|
| 3,674,198 | A * | 7/1972 | Eberle | 494/7 |
| 6,045,760 | A | 4/2000 | Aizawa et al. | |
| 6,121,054 | A * | 9/2000 | Lebl | 506/30 |
| 6,193,642 | B1 * | 2/2001 | Hristake | 494/20 |
| 6,413,780 | B1 * | 7/2002 | Bach et al. | 436/48 |
| 6,416,455 | B1 * | 7/2002 | Aizawa et al. | 494/16 |
| 6,855,553 | B1 * | 2/2005 | Bedingham et al. | 436/45 |
| 6,866,622 | B2 * | 3/2005 | Aizawa | 494/20 |
| 6,991,704 | B2 | 1/2006 | Broadbent | |
| 2003/0017930 | A1 | 1/2003 | Aizawa | |

FOREIGN PATENT DOCUMENTS

| | | | |
|---|---|---|---|
| DE | 1 912 322 | A | 12/1970 |
| DE | 34 25 922 | | 1/1986 |
| DE | 34 25 922 | A1 | 1/1986 |
| DE | 261 107 | | 10/1988 |
| DE | 261 107 | A1 | 10/1988 |
| DE | 199 53 453 | | 5/2001 |
| DE | 199 53 453 | A1 | 5/2001 |
| DE | 102 91 790 | T1 | 7/2003 |
| WO | WO 01/60519 | A1 | 8/2001 |

* cited by examiner

*Primary Examiner*—Jill Warden
*Assistant Examiner*—Dwayne K Handy
(74) *Attorney, Agent, or Firm*—Alston & Bird LLP

(57) ABSTRACT

A centrifuge has a bucket for receiving the product to be centrifuged, and a support which is configured to be inserted in the bucket and receive microtiter plates and the like. The support has substantial stability and comprises a generally planar base and four upstanding lateral walls which are integrally formed with the base and which are coupled together at their upper edges to form a substantially self-contained enclosure.

16 Claims, 5 Drawing Sheets

CENTRIFUGE AND A SUPPORT FOR USE IN A CENTRIFUGE

CROSS REFERENCE TO RELATED APPLICATION

The present application is a continuation of international application PCT/DE2004/001774, filed 6, Aug. 2004, and which designates the U.S. The disclosure of the referenced application is incorporated herein by reference.

BACKGROUND OF THE INVENTION

The present invention relates to a centrifuge comprising at least one bucket for receiving the product to be centrifuged and a support that can be inserted into the bucket and is designed to receive microtiter plates, wherein the support comprises a base and lateral walls extending upwards from the base. Furthermore, the invention relates to a support that is used, for example, in a centrifuge.

Centrifuges of the aforementioned type are known from practical experience, exist in many different embodiments and sizes and are used, for example, in the separation of mixtures of materials with the help of the centrifugal force acting on the product. Centrifuges are known, for example as sedimentation centrifuges. This group of centrifuges also includes the bucket centrifuges, in which buckets, which can rotate about a horizontal axis, are suspended on a vertical shaft and are supported perpendicular to the rotational axis by the centrifugal force.

In bucket centrifuges, supports are used frequently, which are designed for receiving microtiter plates and are inserted for centrifugation into a bucket.

Known centrifuges are frequently involved in an automation process in such a way that the buckets of the centrifuges are loaded and unloaded automatically by means of electronically controllable manipulators. Due to this a high sample throughput can be achieved.

Known supports for microtiter plates comprise a substantially rectangular base and two lateral walls extending vertically from this base on two opposite sides. Between these lateral walls one or more microtiter plates can be then be arranged, if necessary, on top of one another in a sandwich-like manner. The entire arrangement made of support and microtiter plate or microtiter plates can then be provided by means of a manipulator into a bucket of the centrifuge.

The known supports are problematic in several respects. Firstly, very frequently a deflection at least of the upper end of both the lateral walls occurs during a centrifugation. This can lead to the used support being unusable after a brief application, thus requiring it to be replaced by a new support. Furthermore, due to its low form stability the known support does not enable a safe positioning of microtiter plates in the support during the centrifugation. In particular, in the case of a multi-layer design of micro-plates in the support, an unintentional slipping of a lower microtiter plate already inserted into the support can prevent a precisely aligned positioning of several microtiter plates on top of one another by means of an automatic manipulator. Thus a high and reliable sample throughput is not possible in an automatically loadable and unloadable centrifuge.

Furthermore, the manageability of the support with and without inserted microtiter plates is reduced due to its lack of form stability. Particularly in an automatic handling and positioning of the support, it is possible that the supports are not grasped properly and therefore are no longer moveable and positionable in the intended manner.

Finally, there is poor access to the microtiter plates inserted in the support in the region of the existing lateral walls due to the narrowness of the support. This prevents a safe manipulation of the microtiter plates arranged in the support.

Therefore an object of the present invention is to provide a centrifuge and a support of the aforementioned type, according to which a high sample throughput is enabled in an automated operation reliably and using simple means with regard to design.

SUMMARY OF THE INVENTION

The above and other objects and advantages of the invention are achieved by the provision of a centrifuge of the described type and which has a novel support which is configured to be inserted into the bucket of the centrifuge and receive microtiter plates. The support has lateral walls which are coupled together to form with the base a substantially self-contained enclosure.

In the inventive manner it was first concluded that the hitherto usual design of the support does not meet the increasing stability requirements of an automated centrifugation process. Therefore, the lateral walls are coupled together in the invention such that they form a substantially self-contained enclosure that runs along the edge of the base. This enables such an increase in the stability of the support that a deformation of the support during the centrifugation no longer occurs. Furthermore, the support designed according to the invention forms a receiving region that is so stable with respect to its form, that microtiter plates can be smoothly stacked on top of one another one without an unintentional subsequent slipping of individual microtiter plates. This enables a reliable, automated operation of the centrifuge. The loading of the support takes place, as in the case of conventional supports, from the top, namely along the lateral walls up to the base or up to an object, such as for example, a microtiter plate already inserted into the support.

Therefore, using the centrifuge according to the invention, a centrifuge is specified in which a high sample throughout in automated operation is possible reliably and using simple means with regard to design.

With a view to ensure an especially safe coupling of the lateral walls, the lateral walls can be welded together. Here, it is possible to weld especially the region of the upper edges or upper corners of the lateral walls. Finally, the lateral walls are each coupled to two adjoining lateral walls or are welded together.

With a view to ensure a particularly simple handling of the support, a first region can extend outwardly from the upper edge of at least one lateral wall and preferably of all lateral walls. This region could be used for grasping the support by hand, using a tool, or using a manipulator.

Specifically, the first region could be beveled, folded, or bent outwardly at the upper edge of the lateral wall. Here, the lateral wall and the first region could be arranged at an angle of approximately 90° relative to one another.

Within the scope of a particularly simple design, the first region and the adjoining lateral wall could be embodied integrally. This prevents dealing with two different components and/or two different materials of the first region and of the lateral wall. In a specific implementation of the support, the first region could be embodied as the carrying handle.

With a view to ensure a simple loading and unloading of the support with, for example, microtiter plates or other objects, the first region could comprise at least one passageway for the intervention of a tool. Such a tool that could be embodied as a manipulator could be guided through the passageway and then could grasp the microtiter plate or the object at the suitable position.

With a view to ensure a particularly simple handling of a microtiter plate inserted into the support or an object inserted therein, the passageway could be embodied as an oblong hole which extends into the adjoining lateral wall. This enables a tool on a microtiter plate or on another object arranged in the support to almost be moved down and about in the region of the lateral wall, due to which microtiter plates or objects arranged even in the lower region of the support can be grasped by the tool. In a specific design, at least one and preferably two passageways or oblong holes could be embodied on each of the opposite lateral walls of the support. This enables a particularly safe grasp of a microtiter plate or an object.

With a view to ensure a particularly safe grasping and handling of the support, a second region could extend upwards from the outer edge of at least one first region. In doing so the second region could be beveled, folded or bent upwardly at the outer edge of the first region. In an especially simple embodiment with regard to design, the second region and the first region could be embodied integrally. This prevents the handling of two components or two different materials when manufacturing the support. The first and the second region could be arranged at an angle of approximately 90° relative to one another.

Furthermore, with a view to ensure a particularly safe handling and movement of the support, particularly by means of a tool or an automated manipulator, the second region could comprise at least one passageway for the intervention of a tool or a manipulator. Thereby the tool or the manipulator could penetrate through the passageway from inside in order to be able to position and move the support safely. In a concrete embodiment of the support, the second regions could be embodied on opposite lateral walls and/or the first regions. Thereby the second regions could each have at least one and preferably two passageways for the intervention of a tool or a manipulator.

For cutting down on material and weight, at least one passageway could be embodied in the base and/or in at least one lateral wall of the support. In doing so, it must be noted that each of the passageways or recesses are provided on positions, which do not reduce the form stability of the support.

The base of the support could be embodied to be substantially rectangular, wherein the form of a bucket could be taken into consideration for receiving the support.

By the first and also by the second regions extending from the lateral wall and/or the first regions, an increase in the form stability of the support is additionally achieved for forming the substantially self-contained enclosure by the lateral walls. The first and second regions each thereby enable a simplification in the handling of the support or of the microtiter plates or other objects inserted in the support. Due to this a particularly effective combinative effect is achieved, which enables a particularly high sample throughput in the automated operation of a centrifuge reliably and using simple means with respect to design. No additional components made of materials sometimes differing from that of the support are required to be arranged on the support. In principle, the support could be embodied from metal.

The aforementioned object is secondly also achieved by the novel structure of the support itself. At this point, reference is made to the corresponding passages of the above description of the embodiment of the centrifuge according to the invention with the purpose of avoiding a repetition of the specified advantages of the special embodiment of the support.

There are different alternatives for advantageously designing and developing the teaching of the present invention. For this purpose firstly reference must be made to the claims and secondly to the following explanation of a preferred embodiment of the invention based on the drawing.

BRIEF DESCRIPTION OF THE DRAWINGS

Generally preferred design forms and improved configurations of the teaching of the invention are also explained in conjunction with the explanation of the preferred embodiment of the invention based on the drawing, of which.

DETAILED DESCRIPTION OF THE PREFERRED EMBODIMENT

Figure 1:
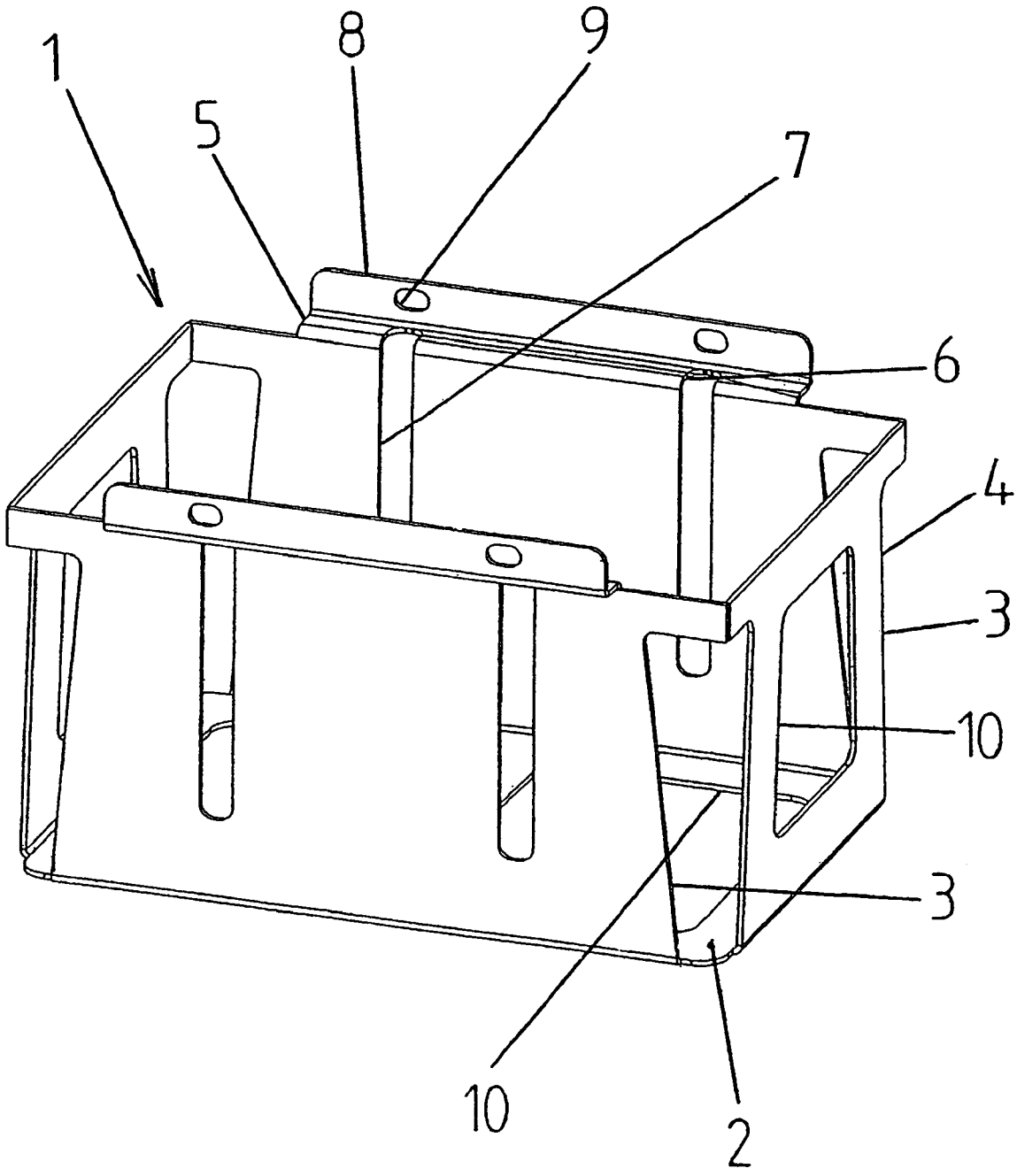
FIG. 1 illustrates a perspective side view of an embodiment of the support of the centrifuge according to the invention, FIG. 2 schematically illustrates a top view of the support shown in FIG. 1 in an opened state.
Figure 5:
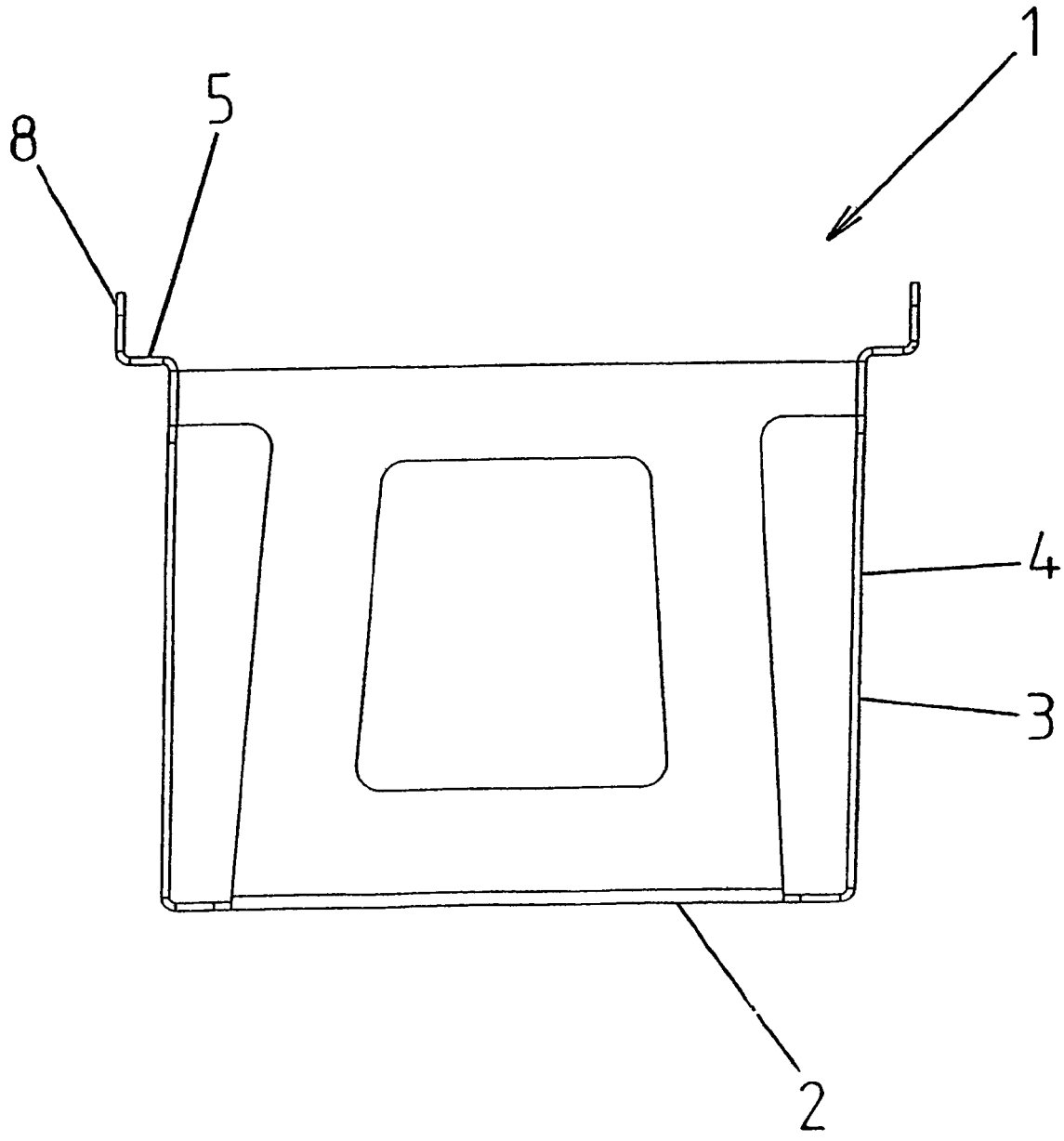
FIG. 5 illustrates a front view of the support shown in FIG. 1.

FIGS. 1 and 5 each illustrate a support 1 which embodies the present invention, and which is used in centrifuges having at least one bucket for receiving the product to be centrifuged. The support 1 is thereby insertable into at least one bucket and is suitable for receiving microtiter plates. The support 1 comprises a rectangular, substantially planar base 2 and lateral walls 3 extending from the four peripheral edges of the base 2.

Figure 2:
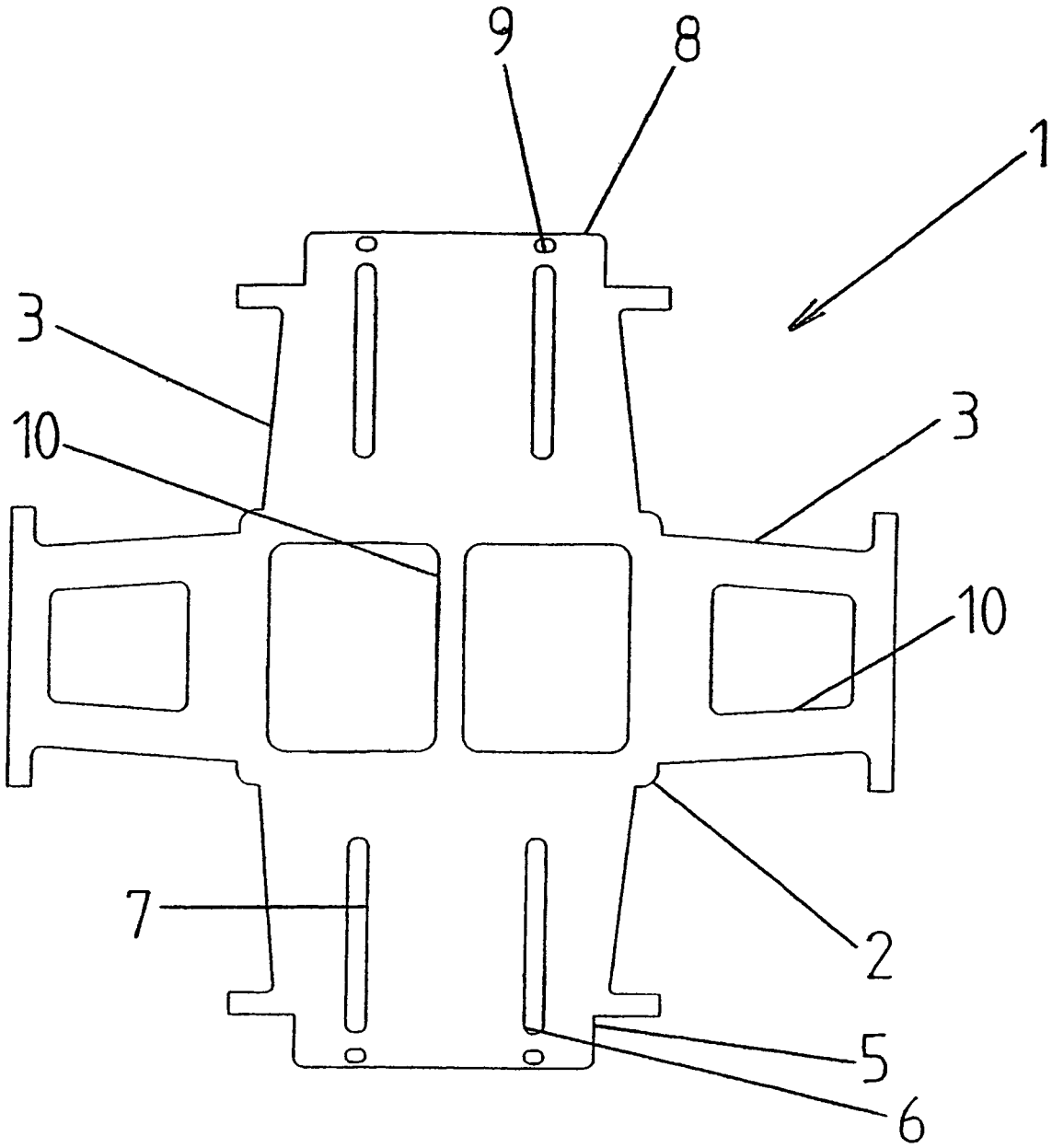
Figure 3:
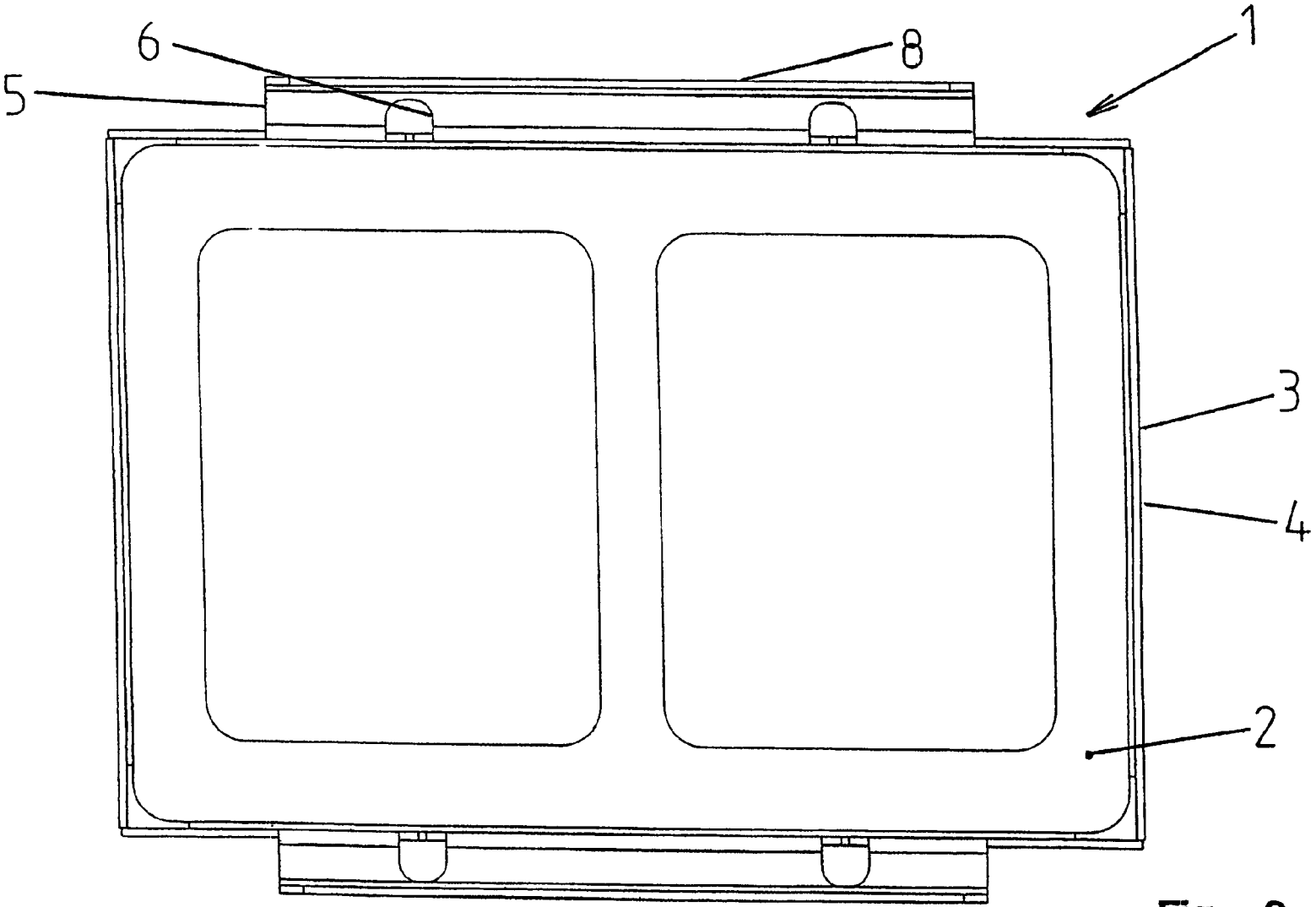
FIG. 3 illustrates the top view of the support shown in FIG. 1.
Figure 4:
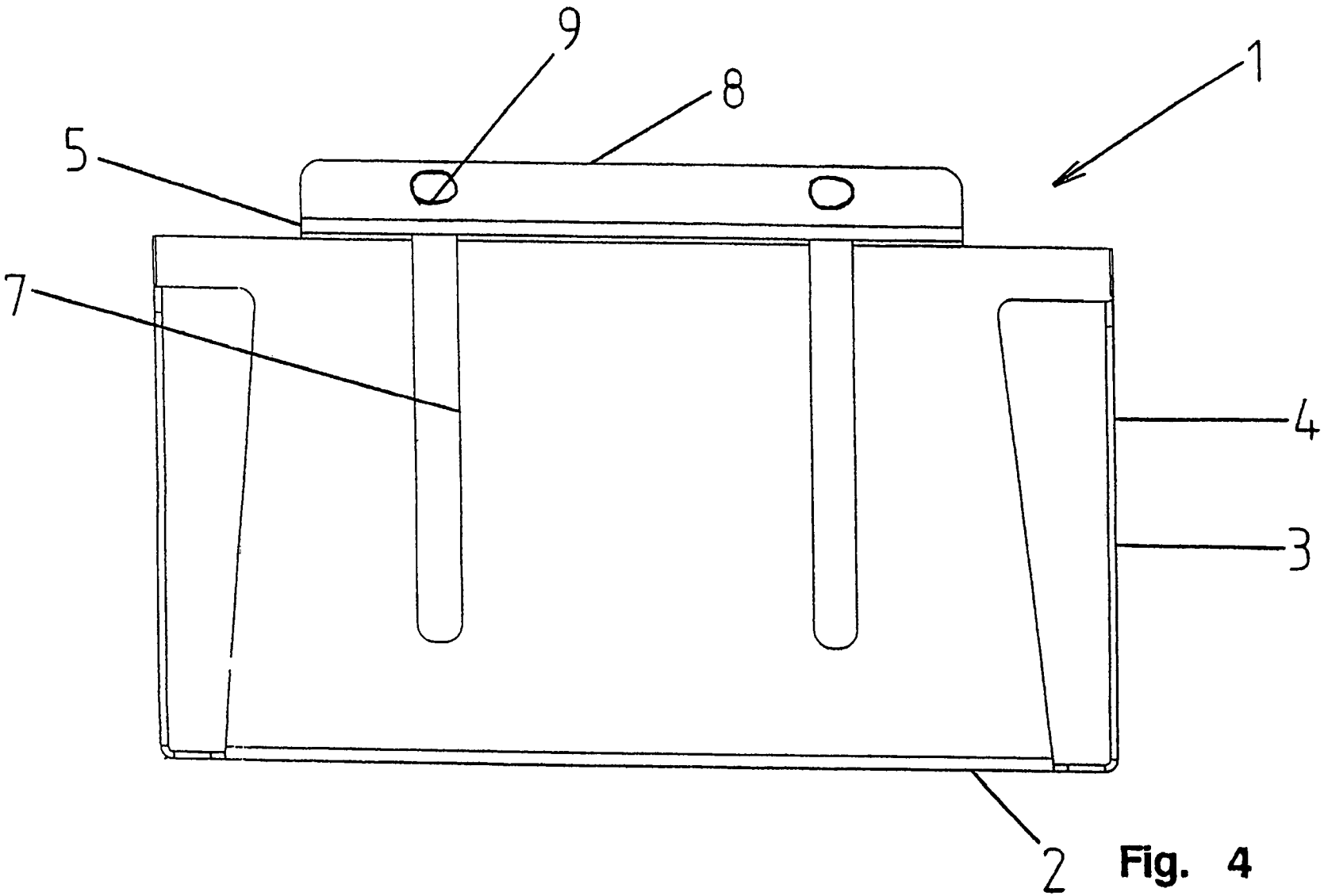
FIG. 4 illustrates the side view of the support shown in FIG. 1

FIG. 1 illustrates the perspective side view of the support 1, FIG. 2 illustrates a top view of the support 1 before its mounting in the opened state, FIG. 3 illustrates the top view of the mounted support 1, FIG. 4 illustrates the side view of the support 1 and FIG. 5 illustrates a front view of the support 1. With a view to ensure a high sample throughput in the automated operation of the centrifuge, the lateral walls 3 are coupled together to form a substantially self-contained enclosure 4 that extends along the edge of the base 2. Due to this a particularly dimensionally stable design form of the support 1 is achieved, wherein the lateral walls 3 are welded in their upper corner regions to each of the adjoining lateral walls 3.

The base 2 comprises a substantially rectangular basic shape. A first region 5 extends outwardly from the upper edge of both the lateral walls 3 embodied on the longitudinal sides of the support 1. However, such a first region 5 could also extend from the lateral walls 3 arranged on the front sides of the support 1. The first regions 5 are used firstly for providing total stability to the support 1 and secondly for the simple handling of the support 1 by, for example, grasping it by hand or using a tool. Even manipulators, in general, and especially manipulators involved in automated processes are classified as tools here.

The first region 5 is folded outwardly at the upper edge of the lateral walls 3. Consequently, the first region 5 and the adjoining lateral wall 3 are embodied integrally.

Each of the first regions 5 illustrated comprises two passageways 6 for the intervention of a tool. Specifically, the passageways 6 are embodied as oblong holes 7 stretching into the respective adjoining lateral wall 3. This enables an intervention of a tool along the lateral walls 3 almost up to the base 2 of the support 1. Due to this even the objects positioned in the region of the base 2 in the support 1 can be handled and advantageously inserted into or removed out of the support 1.

A second region 8 extends upwardly from the outer edge of both the first regions 5. The second region 8 is folded upwardly at the outer edge of the first region 5. Consequently, the second region and the first region 5 are also embodied integrally.

The second regions 8 each comprise two passageways 9 for the intervention of a tool or a manipulator. Due to this an especially safe handling of the support 1 in the automated operation of the centrifuge is possible.

Passageways 10 are embodied in the base 2 and also in the lateral walls 3. These passageways 10 are used for cutting down on weight and also material.

With respect to additional advantageous design forms and improved configurations of the inventive teaching, reference is made firstly to the general part of the description and secondly to the enclosed claims with the purpose of avoiding a repetition.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A centrifuge which comprises at least one bucket for receiving the product to be centrifuged and a support which is configured to be inserted into the bucket and receive microtiter plates, said support comprising a generally planar base defining four peripheral edges, and a lateral wall extending upwardly from each of the peripheral edges of the base, and wherein the lateral walls are coupled together so that the lateral walls and the base form a substantially self-contained enclosure, and wherein a first region extends outwardly from an upper edge of at least one lateral wall and wherein each first region comprises at least one passageway that extends into the adjoining lateral wall and that is configured for the intervention of a tool.

2. The centrifuge according to claim 1, wherein the lateral walls are welded to one another.

3. The centrifuge according to claim 1, wherein the first region is beveled, folded, or bent outwardly at the upper edge of the one lateral wall.

4. The centrifuge according to claim 1, wherein the first region and the adjoining lateral wall are embodied integrally.

5. The centrifuge according to claim 1, wherein a first region extends outwardly at substantially 90° from an upper edge of each of at least the opposite lateral walls.

6. The centrifuge according to claim 1, wherein each passageway is embodied as an oblong hole which extends into the adjoining lateral wall.

7. The centrifuge according to claim 5, wherein a second region extends upwardly from an outer edge of each of the first regions.

8. The centrifuge according to claim 7, wherein each second region is beveled, folded, or bent upwardly at the outer edge of the first region.

9. The centrifuge according to claim 8, wherein each second region and associated first region are embodied integrally.

10. The centrifuge according to claim 7, wherein each second region comprises at least one passageway for the intervention of a tool.

11. The centrifuge according to claim 1, wherein at least one passageway is embodied in the base and/or in at least one lateral wall.

12. The centrifuge according to claim 1, wherein the base is embodied in a substantially rectangular configuration.

13. A support for supporting microtiter plates in a bucket of a centrifuge, comprising a generally planar base defining four peripheral edges, a lateral wall extending upwardly from each of the peripheral edges of the base, said lateral walls being integrally formed with the base and being coupled together adjacent their upper edges so that the lateral walls and the base form a substantially self-contained enclosure, and wherein a first region extends outwardly from an upper edge of at least one lateral wall and wherein each first region comprises at least one passageway that extends into the adjoining lateral wall and that is configured for the intervention of a tool.

14. The support according to claim 13 wherein the first region extends outwardly at substantially 90° from the upper edges of at least two opposite lateral walls, with the first regions being integrally joined to the associated lateral walls.

15. The support according to claim 14 wherein each passageway communicates with an oblong hole which extends vertically into the adjoining lateral wall.

16. The support according to claim 15 wherein a second region extends upwardly from an outer edge of each of the first regions and so as to be parallel to the associated lateral wall, with the second regions being integrally joined to the associated first regions.

* * * * *